US005984439A

United States Patent [19]

Orr et al.

[11] Patent Number: 5,984,439

[45] Date of Patent: Nov. 16, 1999

[54] COMBINED DISPLAY/STORAGE UNIT HAVING ALTERNATELY USEABLE CAPS

[75] Inventors: Henry C. Orr, Syracuse; Donald Crispin, North Syracuse; James Dokoupil, Liverpool, all of N.Y.

[73] Assignee: The Croydon Company, Inc., Liverpool, N.Y.

[21] Appl. No.: 09/064,236

[22] Filed: Apr. 23, 1998

[51] Int. Cl.[6] ..... A47F 9/00

[52] U.S. Cl. ..... 312/140.2; 312/279; 312/249.13

[58] Field of Search ..... 312/114, 249.13, 312/249.12, 249.11, 280, 126, 279, 278, 140.2, 140.1; D6/457, 455; 211/1, 58

[56] References Cited

U.S. PATENT DOCUMENTS

| | | | |
|---|---|---|---|
| D. 353,284 | 12/1994 | Greenwald | D6/457 |
| 747,741 | 12/1903 | March | 312/140.2 |
| 2,023,260 | 12/1935 | Beers et al. | 312/114 |
| 2,088,077 | 7/1937 | Wood | 312/140.3 |
| 3,038,986 | 6/1962 | Molitor | 312/114 |
| 3,039,836 | 6/1962 | Larson | 312/140.3 |
| 3,434,769 | 3/1969 | Salet | 312/114 |
| 4,753,495 | 6/1988 | Swink | 312/114 |
| 4,820,003 | 4/1989 | Lloyd | 312/249.13 |

*Primary Examiner*—Milton Nelson, Jr.
*Assistant Examiner*—Gerald A. Anderson
*Attorney, Agent, or Firm*—George R. McGuire

[57] ABSTRACT

A combined display and storage unit including a cubical base with four side walls, a top wall and a bottom wall, each surrounded and supported by a framework and defining an enclosed storage space. One of the side walls is hinged to provide access to the storage space. Pieces may be supported and displayed on the outer surfaces of the four side walls, preferably by constructing the side walls of slatwall material. The framework surrounding the top wall provides a square recess for alternatively receiving a transparent display case, a wire book support and a merchandise tray. The base is preferably mounted on casters for free movement.

12 Claims, 5 Drawing Sheets

FIG. 4A
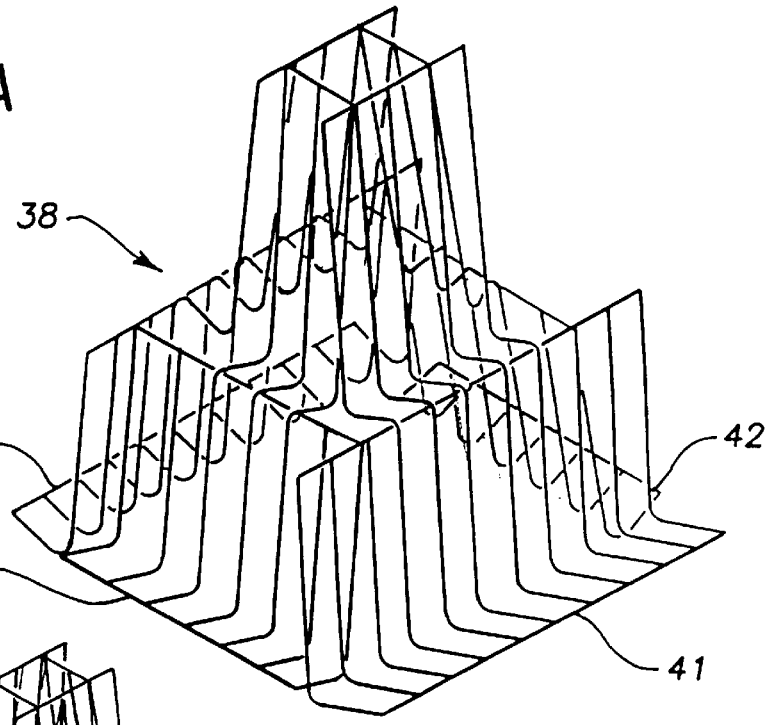
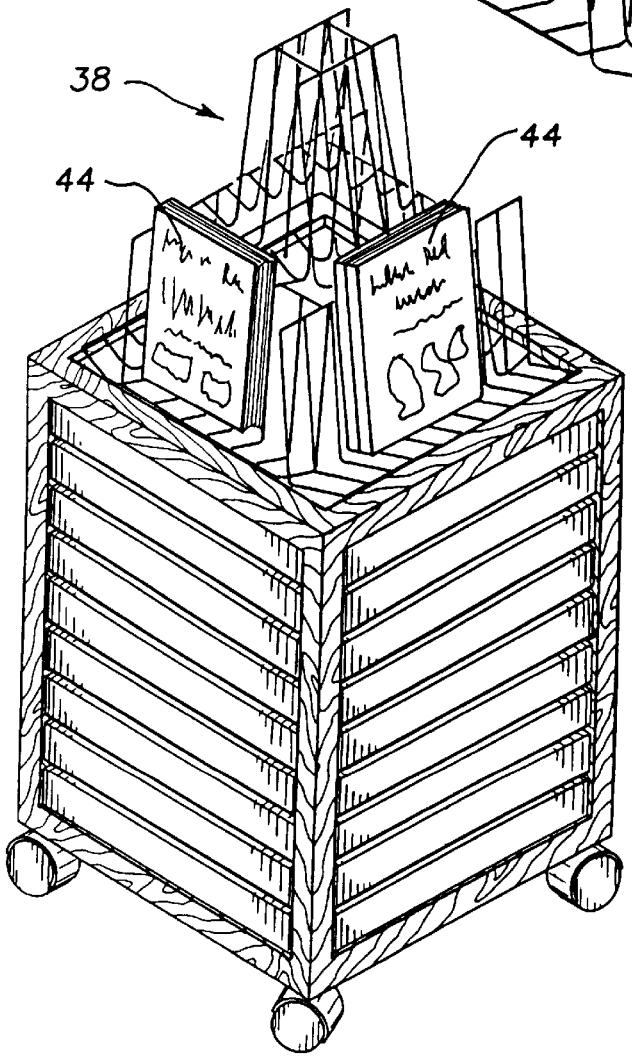
FIG. 4B

COMBINED DISPLAY/STORAGE UNIT HAVING ALTERNATELY USEABLE CAPS

BACKGROUND OF THE INVENTION

The present invention relates to structures for displaying various pieces of merchandise, or other items, while also providing enclosed storage space; more specifically, the invention relates to mobile, cubical enclosures having outer wall surfaces suited for support of displayed pieces, and a plurality of different items which may alternately be placed atop the cube for various display purposes.

It is a principal object of the present invention to provide novel and improved structures for displaying printed matter, pieces of merchandise, etc. and including enclosed storage space.

A further object is to provide a base unit having side walls defining an enclosed storage space with outer surfaces adapted to support and display printed matter and other items, and a horizontal top surface for alternately supporting any of several types of additional support and display structures.

Other objects will in part be obvious and will in part appear hereinafter.

SUMMARY OF THE INVENTION

In the preferred embodiment, the apparatus of the invention is in the form of a hollow cube having four side walls, one of which is hinged to serve as a door, as well as top and bottom walls. Locking casters are mounted at the four corners of the bottom wall, or a surrounding framework, to provide mobility of the unit. The outer surfaces of the side walls are of the so-called "slatwall" design to which hangers for supporting and displaying books, cassettes, and the like, may be removably affixed. The upper surface of the top wall includes a square recess which selectively and alternatively accepts any one of a clear, acrylic exhibit case, a wire book pyramid or a merchandise tray.

The foregoing and other features of construction and alternate uses of the invention will be more readily understood and fully appreciated from the following detailed description, taken in conjunction with the accompanying drawings.

BRIEF DESCRIPTION OF THE DRAWINGS

FIG. 4A is a perspective view of a second item for optional use with the base unit;

FIG. 4B is a perspective view of the item of FIG. 4A mounted upon the base unit with books displayed thereon;

DETAILED DESCRIPTION

Figure 1:
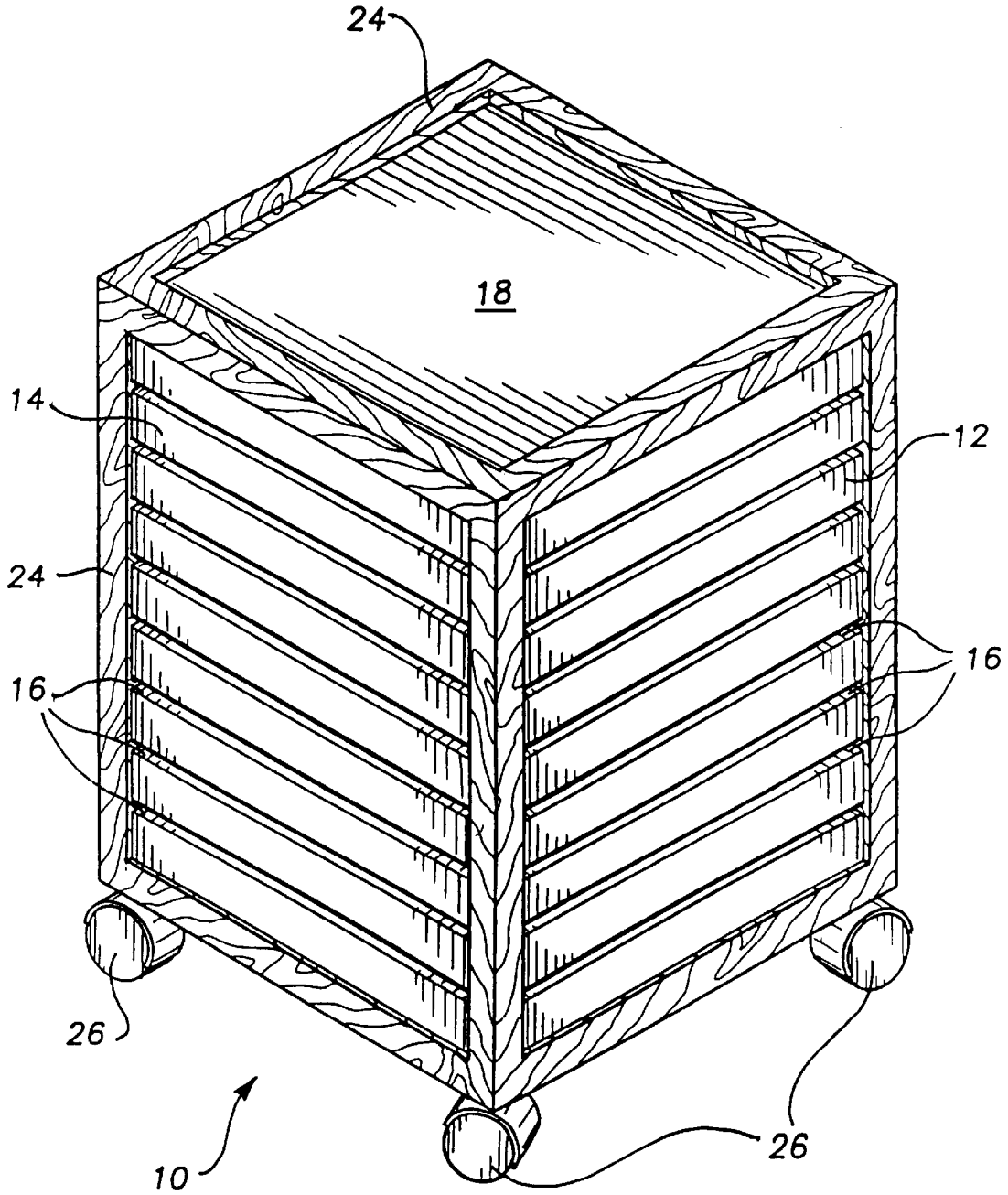
FIGS. 1 and 2 are perspective views of the base unit of the invention with a door thereof in closed and partly open positions, respectively.
Figure 2:
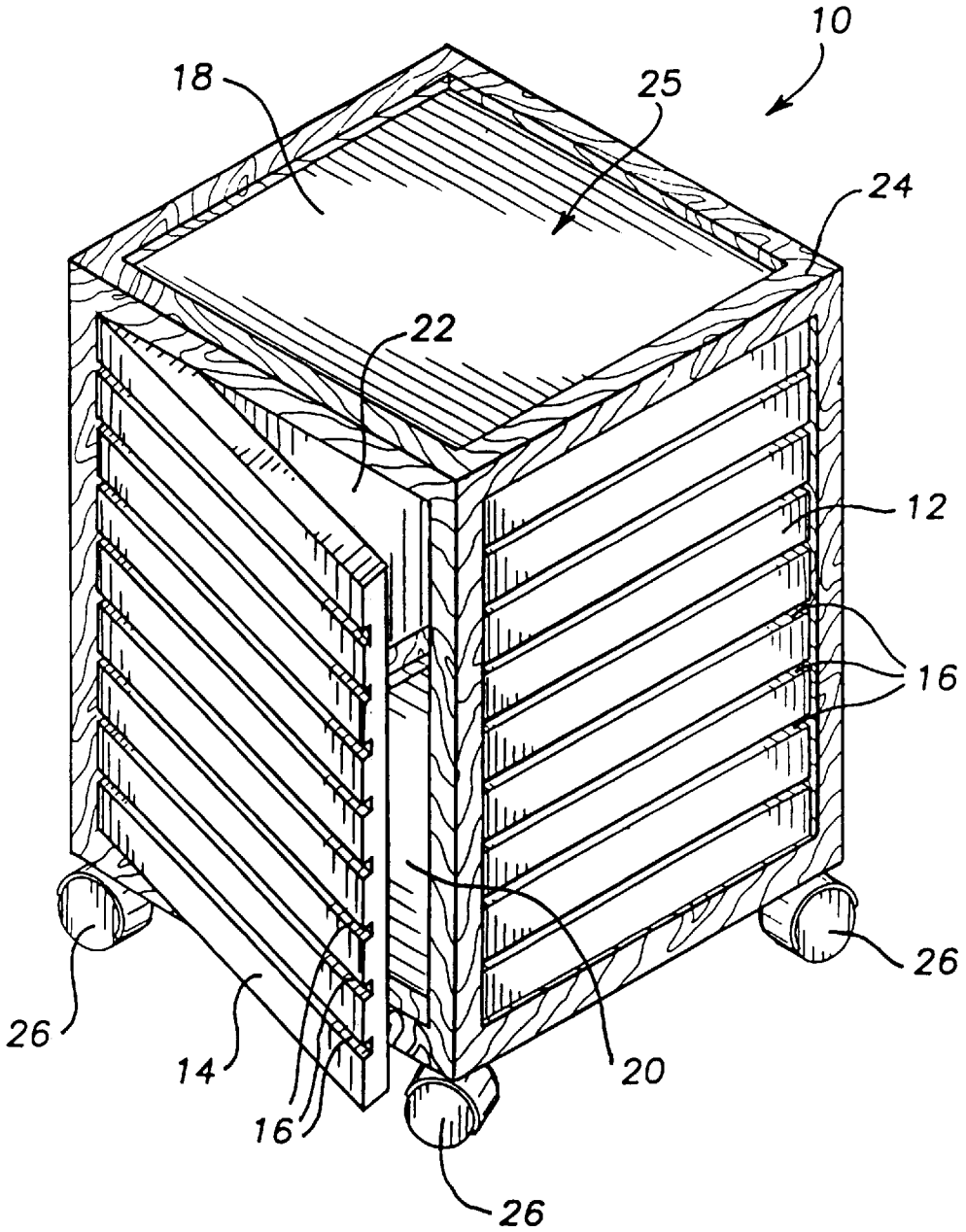
Figure 3A:
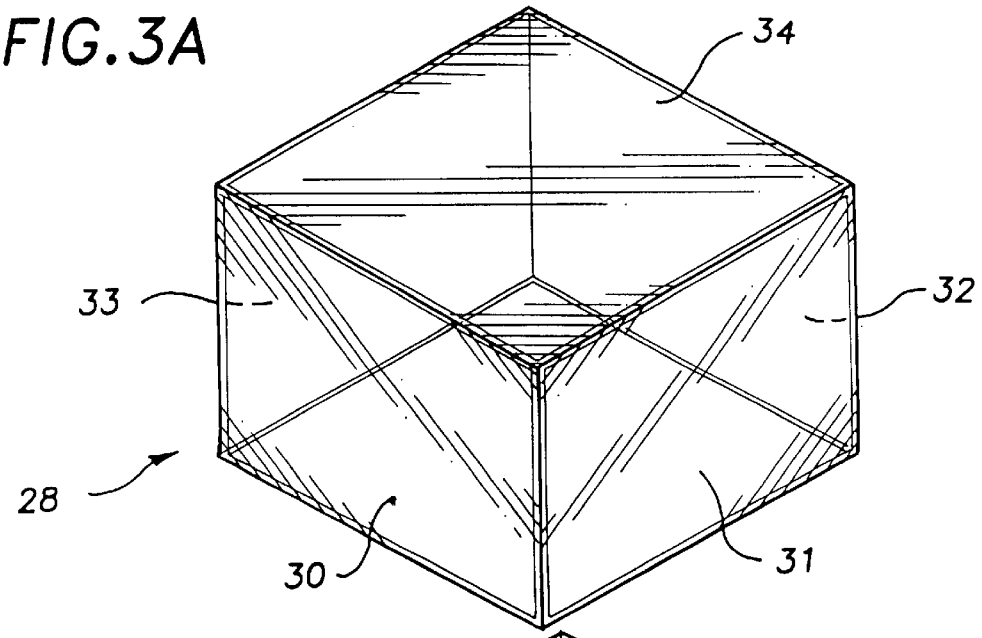
FIG. 3A is a perspective view of an item for optional use with the base unit.
Figure 3B:
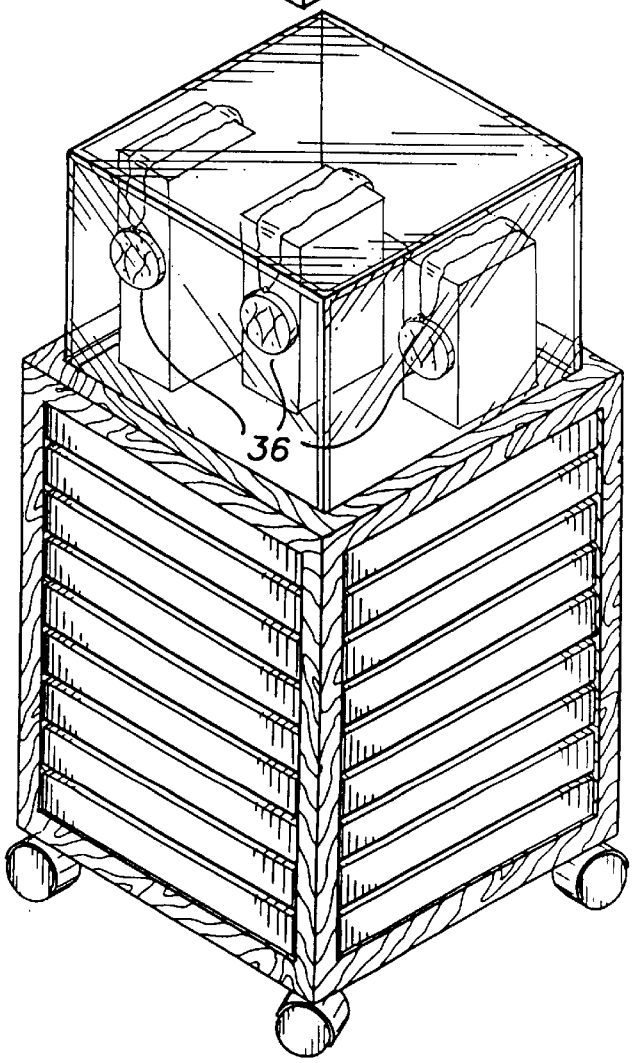
FIG. 3B is a perspective view of the item of FIG. 3A mounted upon the base unit with additional items displayed therein.

Referring now to the drawings, the base unit of the invention, denoted generally by reference numeral 10, is shown in FIGS. 1 and 2. Base unit 10 includes four, square side walls, two of which are shown and each of which has an outer surface of the design known as slatwall, i.e., a planar surface having a succession of evenly spaced, horizontal grooves. Side walls numbered 12 and 14 are shown in FIG. 1 with the grooves in each denoted by numeral 16. In FIG. 2 it is seen that wall 14 is hinged along one vertical edge to sense as a door for the space defined by the four side walls, plus top wall 18 and bottom wall 20, a portion of the latter being visible in FIG. 2 together with the inner surface of side wall 22.

All six walls are surrounded and supported by framework 24. The outer surfaces of all walls are recessed into the surrounding framework, i.e., framework 24 forms a raised border defining a square recess on each side of the cubical unit 10. The recess formed by the portion of the framework surrounding top wall 18 is indicated by reference numeral 25. Casters, three of which are seen and indicated by reference numeral 26, are mounted to framework 24 adjacent the four corners on the lower side thereof, at least some of the casters preferably being of the locking type. Thus, unit 10 may be freely movable or fixed in a desired position when casters 26 are unlocked and locked, respectively.

Case 28 consists of four side walls 30, 31, 32 and 33, and top wall 34. Each of side walls 30–33 has a length equal to or slightly less than the equal lengths of each side of recess 25. Thus, case 28 may be placed with the lower edges of side walls 30–33 in recess 25 to cover and protect items 36 placed on top wall 18 of unit 10.

Wire display pyramid 38 is shown in FIG. 4A and may take any of a number of suitable configurations. Wires 40, 41, 42 and 43, forming the four sides of the base of pyramid 38, have lengths the same as, or less than, the lengths of each side of recess 25. Plyramid 38 may be placed in recess 25, as shown in FIG. 4B, to support and display items such as books 44.

Figure 5A:
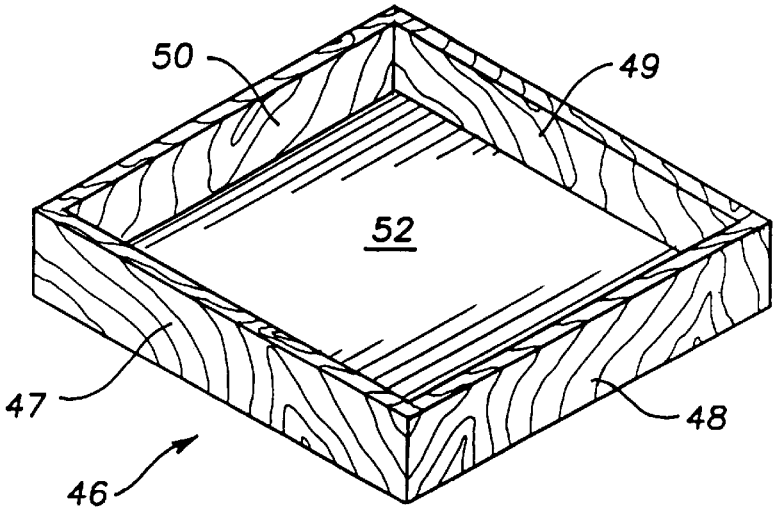
FIG. 5A is a perspective view of a third item for optional use with the base unit.
Figure 5B:
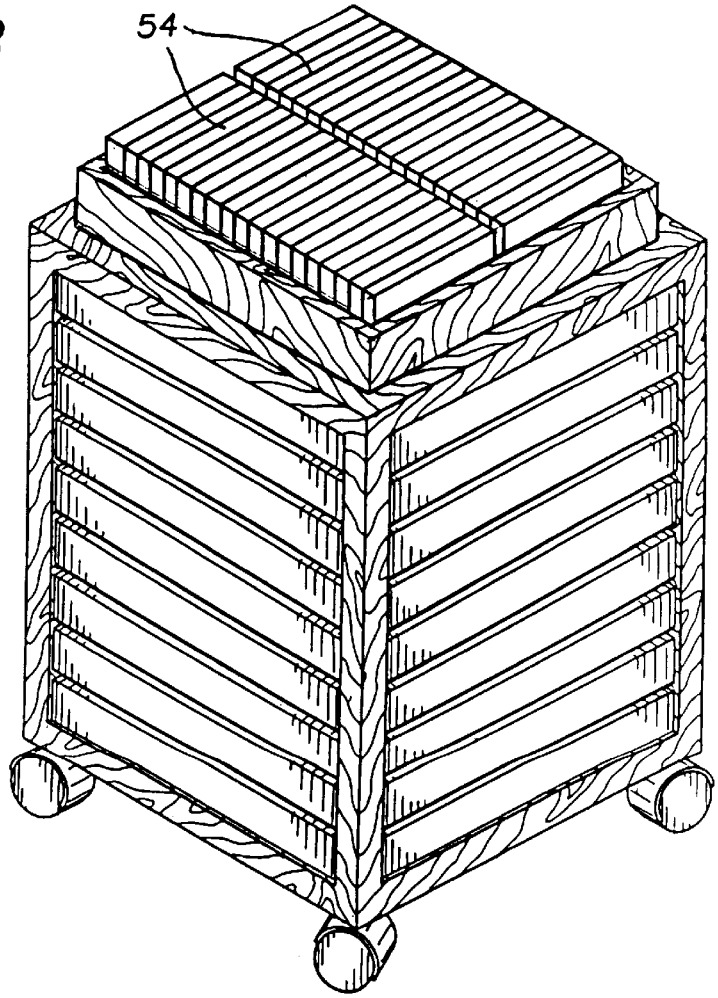
FIG. 5B is a perspective view of the item of FIG. 5A mounted upon the base unit and holding additional items for display.

Merchandise tray 46, consisting of four side walls 47, 48, 49 and.50, and bottom wall 52, is shown separately in FIG. 5A and placed in recess 25 in FIG. 5B. Items 54, such as compact discs in conventional cases, may be held and displayed in tray 46, carried on the top of unit 10.

From the foregoing, it may be seen that unit 10 provides a useful and versatile display and storage structure. The slatwall design of the outer surfaces of the side walls accepts conventional hanger devices (not shown) for supporting and displaying diverse types of items. The top of the unit accepts any of a plurality of protective, support and display structures, adding to the capacity and utility of the unit. The storage space defined by the walls of the unit may include fixed or adjustable shelves, while the unit itself may be freely moved from place to place or fixedly positioned in a desired location.

What is claimed is:

1. A combined display and storage unit having means for mounting selectively interchangeable items for increasing the display capacity of the unit, said unit comprising:

a) a cubical base having four square side walls, a square top wall and a square bottom wall defining an enclosed storage space;

b) hinge means for at least one of said side walls permitting opening and closing movement of said at least one side wall with respect to said storage space;

c) each of said walls having an outer surface, the outer surfaces of said side walls having a plurality of spaced, horizontal grooves in said outer surface of each of said side walls for supporting displayed items;

d) a framework having portions surrounding and supporting each of said walls, the portion of said framework surrounding at least said top wall lying in a plane parallel to and above the plane of said top wall outer surface, thereby forming a laterally bounded recess immediately above said top wall outer surface of receiving a selected one of said interchangeable items.

2. The unit of claim 1 wherein the lateral boundary of said recess is square.

3. The unit of claim 1 and further including four casters respectively mounted adjacent the corners of said bottom wall, said unit being freely movable upon said casters.

4. The unit of claim 1 wherein the material of said doors is slatwall.

5. The unit of claim 1 wherein said outer surface of all of said walls is planar and the portion of said framework surrounding each of said walls lies in a plane parallel and spaced outwardly with respect to said outer surface of the surrounded wall, thereby forming a recess laterally bounded by said framework adjacent each of said outer surfaces of all of said walls.

6. The unit of claim 5 wherein the lateral boundary of all of said recesses is square.

7. An assemblage of components collectively defining a combined display and storage unit with a plurality of selectively interchangeable items for expanding the display capacity of the unit, said assemblage comprising:

a) a cubical base unit having side walls, a top wall and a bottom wall defining a storage space, and a framework having respective portions surrounding and supporting each of said walls, said framework having edges defining a cube and each of said walls having an outer surface with a plurality of vertically spaced, horizontally extending grooves formed therein;

b) the portion of said framework surrounding at least said top wall lying in a horizontal plane, parallel to and spaced above said outer surface of said top wall, thereby providing a recess immediately above said top wall laterally bounded by said portion of said framework surrounding said top wall;

c) hinge means for mounting one of said walls for opening and closing movement with respect to said storage space; and d) each of said plurality of selectively interchangeable items having respective, unique functions, and an upper and a lower side, said lower side having an outer boundary sized to fit within said lateral boundary of said recess, whereby any one of said items may be placed on said upper surface of said top wall and surrounded by said portion of said framework surrounding said top wall, each of said items including means for one of supporting and covering displayed pieces.

8. The assemblage of claim 7 wherein one of said items is a wire book support having a lower peripheral boundary sized to fit closely within said lateral boundary of said recess, whereby said book support may be placed upon said outer surface of said top wall, surrounded closely by said framework, and books placed upon said support for display.

9. The assemblage of claim 7 wherein one of said items is a merchandise tray having a lower wall and four peripheral walls extending perpendicularly from said lower wall, said peripheral walls having outer surfaces bounded by a square outline sized to fit closely within said lateral boundary, said tray having an open top, whereby said tray may be placed upon said outer surface of said top wall, closely surrounded by said framework, and pieces placed within said tray for display.

10. The assemblage of claim 7 wherein a first of said items is an exhibit case comprising four transparent side walls and a transparent top wall, said transparent side walls having free edges defining a square outline sized to fit closely within said lateral boundary of said recess, whereby pieces for display may be placed upon aid outer surface of said top wall, covered by said exhibit case with said free edges closely surrounded by said framework, and viewed through said transparent side walls and said transparent top wall, a second of said items is a wire book support having a lower peripheral boundary sized to fit closely within said lateral boundary of said recess, whereby said book support may be placed upon said outer surface of said top wall, alternatively to said exhibit case, surrounded closely by said framework, and books placed upon said support for display, and a third of said items is a merchandise tray having a lower wall and four peripheral walls extending perpendicularly from said lower wall, said peripheral walls having outer surfaces bounded by a square outline sized to fit closely within said lateral boundary of said recess, said tray having an open top, whereby said tray may be placed upon said outer surface of said top wall, alternatively to said exhibit case and said book support, closely surrounded by said framework, and pieces placed within said tray for display.

11. The assemblage of claim 7 wherein each of said side walls is constructed of slatwall material.

12. The assemblage of claim 7 wherein one of said items is an exhibit case comprising four transparent side walls and a transparent top wall, said transparent side walls having free edges defining a square outline sized to fit closely within said lateral boundary of said recess, whereby said pieces for display may be placed upon aid outer surface of said top wall, covered by said exhibit case with said free edges closely surrounded by said framework, and viewed through said transparent side walls and said transparent top wall.

* * * * *